United States Patent [19]

Geronimo

[11] Patent Number: 4,719,952

[45] Date of Patent: Jan. 19, 1988

[54] SURFBOARD HORIZONTAL CONTROL SURFACE PROTECTION METHOD AND APPARATUS

[76] Inventor: John D. Geronimo, 406 S. Lucia, Redondo Beach, Calif. 90277

[21] Appl. No.: 933,935

[22] Filed: Nov. 24, 1986

[51] Int. Cl.[4] ..... A63C 15/05

[52] U.S. Cl. ..... 150/52 R; 114/219; 114/361; 206/315.1; 428/81; 428/99; 428/192; 441/74

[58] Field of Search ..... 114/219, 361; 441/74; 156/293; 206/315.1; 428/81, 99, 192

[56] References Cited

U.S. PATENT DOCUMENTS

| | | | |
|---|---|---|---|
| 2,150,988 | 3/1939 | Russell | 428/99 X |
| 2,337,787 | 12/1943 | Waller, Jr. | 114/219 |
| 2,389,729 | 11/1945 | Howland | 441/74 |
| 3,339,607 | 9/1967 | Howard | 150/52 R |
| 3,374,495 | 3/1968 | Joyce | 441/74 |
| 3,543,315 | 12/1970 | Hoffman | 156/79 X |
| 3,929,549 | 12/1975 | Smith | 156/304.2 X |
| 4,153,230 | 5/1979 | Giacian | 428/192 X |
| 4,307,765 | 12/1981 | Davis | 428/81 X |
| 4,350,546 | 9/1982 | Davis | 428/81 X |
| 4,483,380 | 11/1984 | Beran | 150/52 R |
| 4,556,003 | 12/1985 | Prade | 441/74 X |
| 4,586,451 | 5/1986 | Mori | 441/74 X |
| 4,647,487 | 3/1987 | O'Neill | 428/81 |

*Primary Examiner*—Henry F. Epstein

*Attorney, Agent, or Firm*—Poms, Smith, Lande & Rose

[57] ABSTRACT

A reusable, low bulk, temporary shock absorbing cover for protecting the delicate tips and horizontal control edge surfaces of conventional surfboards and the like is disclosed. The cover comprises a first resilient shock absorbing pocket for enclosing the forward tip of a conventional surfboard and a corresponding second shock absorbing pocket for protectively enclosing the rear base of the surfboard. A pair of substantially identical resilient shock absorbing members are longitudinally disposed between the first and second pockets in generally parallel spaced opposed relationship for protectively covering the horizontal control edge surfaces of the surfboard. Additional position retaining straps may also be utilized to interconnect the shock absorbing members. A method for utilizing the protective shock absorbing cover is also disclosed.

5 Claims, 5 Drawing Figures

Fig. 1.
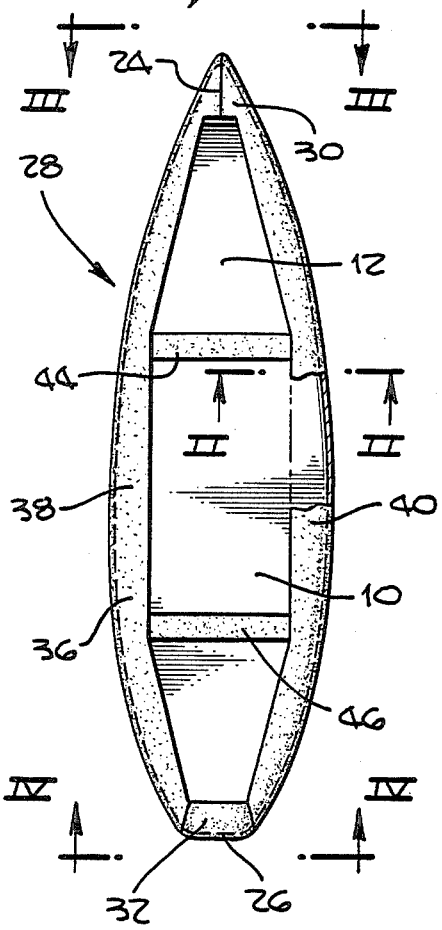
Fig. 2.
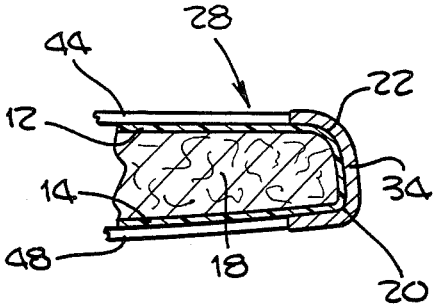
Fig. 3.
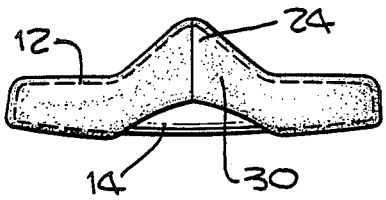
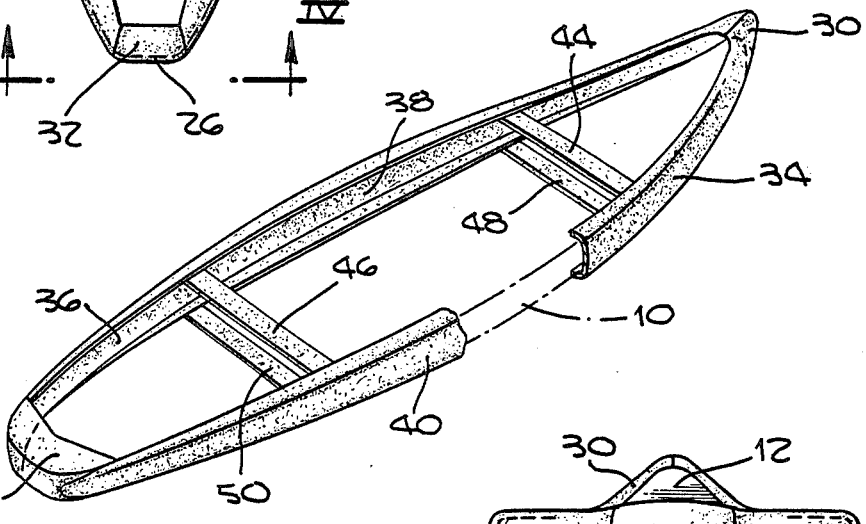
Fig. 5.
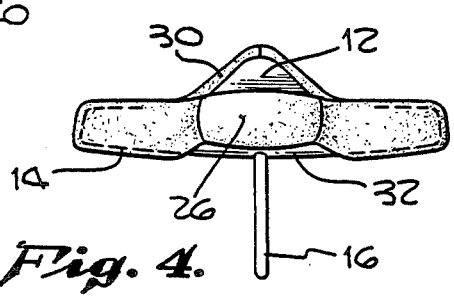
Fig. 4.

SURFBOARD HORIZONTAL CONTROL SURFACE PROTECTION METHOD AND APPARATUS

FIELD OF THE INVENTION

The present invention relates in a broad aspect to a method and apparatus for protecting the fragile external surface areas and edges of bulky, rigid objects when in transit or storage. More particularly, the present invention is directed to a method and apparatus for effectively protecting the longitudinal control edge surfaces of a conventional, modern day surfboard or the like from scratches, fractures and impact damage incurred during transit or storage.

BACKGROUND OF THE INVENTION

Over the years, paddle boards, surfing boards and sail boards have evolved from 12 and 14 foot solid mahogany carvings and hollow wood laminates to today's modern, ultra light polyurethane foam and fiberglass composition structures. Typically, a modern surfboard will range from approximately five feet to seven feet or more in length and be formed of an ultra lightweight foam core reinforced with one or more longitudinal laminated wood "stringers" shaped to specifically designed contours prior to being encased in a thin, lightweight layer of fiberglass reinforced resin. Though the body of this application will primarily discuss the present invention in the context of surfboards, those skilled in the art will appreciate that modern day paddleboards, sailboards, kneeboards and the like are formed in essentially the same manner.

The reduction in size and weight associated with this modern surfboard construction has resulted in substantial increases in the maneuverability and controllability of the surfboard itself. Along with this change in construction, the overall shape of surfboards has evolved into a highly specialized configuration which further enhances the controllability and maneuverability of the surfboard when in use. Typically, the surfboard silhouette is shaped to resemble a symmetrical projectile having a pointed "nose" or front tip which gradually broadens to a maximum width at or near the midpoint of the longitudinal extent of the board before smoothly tapering to a somewhat broad rear base having any of a variety of symmetrical tail configurations ranging from blunt or "squash tail" through indented "swallowtail" designs to pointed "pintail" configurations. Viewed longitudinal in cross section, the "nose" or forward tip of the surfboard gently curves upward from about the midsection or first third of the board to the most forward extent, while the somewhat broader rear end or "tail" remains relatively flat.

Though most modern day surfboards are provided with from 1 to 4 vertically aligned tail fins or keel-like structures, known in the surfing vernacular as a "skag", a significant influence on the control and maneuverability of the surfboard is provided by the individual, longitudinal, horizontal edge configurations or "rails". When viewed in perpendicular cross section, the "rails" present a sharp, low drag angle in contact with the surface of the wave much like the edges of a conventional snow ski. The corresponding upper surface of each "rail" is smoothly radiused into the top or "deck" of the board upon which the surfboard operator stands. The underside or "belly" of the board typically is formed in either a flat or shallow V-section to further enhance speed and maneuverability by reducing drag.

In spite of these benefits, a significant drawback to the lightweight fiberglass encased foam structures of modern day surfboards and the like is their susceptibility to damage from abrasive materials, cracking, stress fractures and impact. Such damage does more than merely detract from the visual appearance of these relatively expensive athletic apparatus. Rather, the areas most vulnerable to such damage, the side "rails", are essential for effective control of the surfboard in the water. Disruption of the carefully crafted contours of the "rail" edges through damage causes unwanted drag which affects the balance, maneuverability and performance of the surfboard. Moreover, cracks and impact damage tend to focus the stresses of the board to the damaged area causing the injury to grow and expose more of the fragile porous foam inner core. As a result, the exposed core of a damaged surfboard is prone to the absorption of sea water which dramatically changes the symmetrical balance and handling of the board.

In the past, the majority of such damage was incurred through contact with rocks and other hard obstacles located on the sea shore when an unattended board was washed ashore by wave action after the rider was thrown from the board or lost his or her balance. However, modern day surfers utilize a tether to strap the surfboard to one of their ankles in order to prevent this occurrence. As a result, the majority of damage to modern day surfboards is incurred during storage and transit.

For example, conventional surfboard racks utilized to transport surfboards on the roofs of cars or trucks utilize clamps which may crush or stress fracture the thin fiberglass skin of the board. Additionally, mass transportation and air travel may subject the relatively large and awkward surfboards to a number of violent impacts and severe abrasive injuries. Windsurfers, sailboards and the like which are substantially identical in construction to surfboards, only larger, are prone to suffer the same forms of damage.

Prior art methods at dealing with these problems have tended to involve relatively heavy, bulky, rigid surfboard cases provided with collapsible foam liners which encase the board much like a modern day camera or guitar case. Aside from the bulk and expense of these rigid surfboard transportation cases, a serious drawback is the inability to store the case itself in a convenient location after the surfboard has been removed for use. Moreover, the upper "deck" surface of most surfboards typically is coated with a layer of high melting temperature wax to repel water and enhance the operator's ability to impart control inputs into the board utilizing his or her feet when standing on the board. This wax may be removed by the foam liner and invariably accumulates beach sand and grit which may be transferred to the foam liner and hinges of the rigid case, possibly scratching the surface of the board or interfering with the operation of the case. Such rigid cases are also difficult to mount on conventional automobile surfboard roof racks, especially when stacked in tandem which is a common occurrence with unprotected boards.

An alternative protective device currently in use is a surfboard bag formed of a woven fabric material and contoured to completely enclose the surfboard prior to closing the bag with a drawstring. Though effective at absorbing minor impacts, such soft surfboard bags provide little if any protection from the major impacts commonly associated with surfboard transportation and accidental dropping in transit or storage. Moreover, they provide no protection from the compressive or stress cracking forces associated with conventional surfboard roof racks. Additionally, surfboard bags also make contact with the waxed upper surface of the surfboard and may accumulate wax and grit on their inner surfaces or remove wax from the surfboard "deck."

Accordingly, it is principal object of the present invention to provide a method and apparatus for effectively protecting the critical longitudinal horizontal control edge surfaces about the circumference of a conventional, modern day surfboard.

It is a further object of the present invention to provide a method and apparatus for protecting the circumferential horizontal control edge surfaces of a surfboard that will not contact or alter the waxed upper surface of the board when in use.

It is a further object of the present invention to provide a method and apparatus for protecting the horizontal control surfaces of a surfboard that can be used in conjunction with a conventional soft surfboard bag or surfboard transporting roof rack.

It is an additional object of the present invention to provide an apparatus for protecting the horizontal control edge surfaces of a conventional surfboard that can be mounted or removed from the surfboard simply and easily and is capable of repeated usage.

Moreover, it is a further additional object of the present invention to provide a method and apparatus for protecting the horizontal control edge surfaces of a surfboard which can be stored conveniently in a minimum of space when not in use.

SUMMARY OF THE INVENTION

These and other objects are achieved by the method and apparatus of the present invention which effectively protects the longitudinal, horizontal control edge surfaces of modern day surfboards, sailboards, and the like from scratches, abrasions, fractures and impact damage during transit or storage without altering or interfering with the waxed upper surface of the board. The apparatus of the present invention comprises a reusable, temporary, shock absorbing cover formed of a low mass, low bulk material which can be positioned about the ends and the circumferential, longitudinal edges of the surfboard to protect them from damage.

More specifically, the shock absorbing protective cover of the present invention is formed of a first shock absorbing pocket means, in the preferred embodiment a resilient, shock absorbing protective cup which encases the forward tip of the surfboard, and a corresponding second pocket means or protective cup for encasing the rear base of the surfboard. Completing the protective cover are a pair of flat or generally planar, resilient, shock absorbing members for protectively covering the longitudinal, horizontal control edge surfaces between the tip and base of the surfboard by assuming a configuration closely molded to the contours of the surfboard edges. Each shock absorbing member is attached by its opposing ends to one side of both the first and second pocket means. Thus, the shock absorbing members longitudinally extend between the first and second pockets and are positioned to oppose one another in a substantially parallel spaced relationship which can be positioned conveniently and easily about the longitudinal, horizontal edges of a conventional surfboard or the like.

It is also contemplated as being within the scope of the present invention to interconnect the longitudinally extending shock absorbing members of the protective cover with one or more position retaining straps. These straps can completely encircle the surfboard or cover only a portion of the upper or lower surface. Though not essential to the practice of the present invention the use of at least one position retaining strap is preferred as it assists in maintaining the shock absorbing members in protective engagement with the horizontal control edges of the surfboard.

Those skilled in the art will appreciate that the unique configuration of the shock absorbing cover of the present invention will effectively protect the circumferential horizontal control surfaces of the surfboard without interfering or modifying the normally waxed upper surface of the surfboard. This is because only the vulnerable tips and edges are covered while the waxed deck surface remains exposed. Nonetheless, the apparatus of the present invention is effective at protecting all surfaces of the surfboard because the resilient shock absorbing cover spaces the deck and belly of the board away from any external surfaces which the encased board may come into contact with. Thus, all impact and stress is absorbed into the protective cover about the edges and ends of the surfboard and the fragile edges and surfaces themselves are spared from damaging contact.

The shock absorbing cover of the present invention is preferably formed of a neoprene or synthetic rubber foam sheet material. This form of construction provides a shock absorbing cover which has the added benefit of being resistant to sunlight and salt water and thus is well suited to the intended beach environment. Moreover, these closed cell foam materials are sufficiently buoyant to float if inadvertently washed into the ocean. More importantly, neoprene foam sheet is known to be nondamaging to surfboard surfaces, resilient and to have a sufficiently high coefficient of friction to maintain good contact with the surfboard once positioned about its circumferential edges.

To utilize the apparatus of the present invention the tip of a conventional surfboard or the like is first inserted into the first pocket means and then the shock absorbing members are disposed along the respective longitudinal edges by stretching and forming them to the shape and contours of the edges themselves. At that point the rear base of the board is inserted into the second protective pocket means. Those skilled in the art will appreciate that a surfboard protective cover in accordance with the teachings of the present invention which is provided with a position retaining strap will require that the tip of the surfboard be inserted through the position retaining strap prior to its insertion into the first protective cup or pocket means.

A further understanding of the apparatus and method of the present invention will be provided to those skilled in the art from the following detailed description of a preferred exemplary embodiment thereof. Reference will be made to the appended sheet of drawings which will first be described briefly.

BRIEF DESCRIPTION OF THE DRAWINGS

FIG. 1 is a top elevational view of a preferred embodiment of the shock absorbing cover of the present invention shown mounted on a conventional surfboard;

FIG. 2 is a partial cross sectional view taken through the plane II—II of FIG. 1 showing additional features of the shock absorbing cover of the present invention;

FIG. 3 is a front view taken through the plane III—III of FIG. 1 showing the positioning of the first protective cup of the shock absorbing cover of the present invention on the forward tip of the surfboard;

FIG. 4 is a rear view taken through the plane IV—IV of FIG. 1 showing the positioning of the second protective cup of the shock absorbing cover of the present invention on the rear base of the surfboard; and FIG. 5 is an elevated perspective view of the shock absorbing protective cover of the present invention alone illustrating additional features of its configuration.

DETAILED DESCRIPTION OF A PREFERRED EMBODIMENT

Referring more particularly to the drawings, FIGS. 1 through 4 illustrate a preferred embodiment of the reusable, low bulk temporary shock absorbing cover of the present invention, generally indicated by reference numeral 28, positioned upon a conventional surfboard, or the like, generally indicated by reference numeral 10, whose outer configuration is shown in ghost detail. The upper waxed surface 12 of surfboard 10 is clearly visible in the top view of FIG. 1 and rear view of FIG. 4. The corresponding bottom surface 14 of surfboard 10 is clearly visible in FIG. 3. Also visible in FIG. 4 is the vertically oriented keel or skag 16 projecting downwardly from bottom surface 14 of surfboard 10.

Turning now to FIG. 2, a partial cross section of the surfboard 10 taken along plane II—II of FIG. 1 can be seen with its porous form core 18 encased by a thin layer of fiberglass forming upper surface 12 and lower surface 14. Surfboard 10 is contoured symmetrically to form a relatively sharp longitudinal horizontal control edge surface 20 at the outer bottom edge of surfboard 10 and its corresponding upper edge 22 is contoured to smoothly curve into upper "deck" surface 12.

Those skilled in the art will appreciate that control edge surface 20 is extremely important to the functioning of the surfboard in use yet, because of its sharp contours and delicate fiberglass over foam construction it is quite vulnerable to impact damage. Similarly, it also should be noted that the upturned forward tip or "nose" 24 of the surfboard 10, shown in ghost lines in FIGS. 1 and 3, is vulnerable to damage as it focusses stress into a relatively sharp contour formed of thin fiberglass material much like edge 20.

Similarly, the rear base or "tail" 26 of the surfboard is shown in ghost lines in FIGS. 1 and 4 as a blunt tail for purposes of explanation. Like tip 24, base 26 is also susceptible to impact damage and fractures during storage and transit. Those skilled in the art will appreciate that "pin-tail" and "dove-tail" configurations (not shown) also exist which are even more susceptible to injury due to the relatively sharp configurations of such designs. However, the present invention is applicable equally to pin-tail and dove-tail surfboards as well as the blunt tail shown in the figures. Similarly, while bottom surface 14 is shown in FIGS. 2, 3 and 4 as being a shallow V bottom, other configurations are common in the art such as flat bottom or stepped planing hull configurations. The present invention is applicable equally to all such configurations.

With this general understanding of surfboard construction the function of the apparatus of the present invention is clearly shown in FIG. 1. The shock absorbing cover of the present invention is generally indicated by reference numeral 28. In the preferred embodiment shown, cover 28 is formed of a first shock absorbing resilient pocket means 30 for protectively encasing forward tip 24 of surfboard 10. In the preferred embodiment of the present invention, pocket means 30 comprises a cup formed of neoprene foam material which has been cut and glued or stitched to a configuration which closely approximates the outer configuration of tip 24. Preferably, first pocket means 30 is sized to snugly fit about tip 24 in a form fitting arrangement.

Similarly, a corresponding second resilient shock absorbing pocket means 32 is shown for protectively encasing base 26 of surfboard 10. Preferably, second pocket means 32 is also formed of a neoprene foam sheet material which has been configured to snugly enclose the entire outer surface of base 26. It will be appreciated by those skilled in the art that differing tail configurations may require modification to the corresponding configuration of second pocket means 32. For example, a narrow pin-tail surfboard (not shown) would require a narrow second pocket means which would more closely approximate the configuration shown in first pocket means 30 disposed about the relatively narrow pointed tip 24. However, a dove-tail surfboard (not shown) would not require significant modification.

As shown in FIG. 1, longitudinally extending between first and second pocket means 30 and 32 are a pair of substantially identical, generally planar resilient shock absorbing members 34 and 36. The configuration of shock absorbing members 34 and 36 is clearly shown in FIG. 5. Shock absorbing members 34 and 36 each have widened mid sections 38 and 40 and taper to opposed ends which are attached to first pocket means 30 and second pocket means 32, respectively. As a result, as shown in FIGS. 1 and 5, both resilient shock absorbing members 34 and 36 are attached to and longitudinally extend between first and second pocket means 30 and 32 and are widest at midpoints 38 and 40. As with pocket means 30 and 32, resilient shock absorbing members 34 and 36 are preferably formed of neoprene foam sheet.

As shown in the partial cross sectional view of FIG. 2, the resilient shock absorbing members 34 and 36 (not shown) protectively cover the fragile longitudinal horizontal control edge surface 20 and corresponding upper edge 22 by resiliently assuming a shape corresponding to the contours of surfboard 10 disposed within cover 28. Moreover, the resilient shock absorbing members are preferably sufficiently thick to space upper waxed surface 12 and bottom surface 14 away from contact with any external horizontal surfaces. Thus, if board 10 were to be dropped or laid upon a sidewalk or pier, shock absorbing members 34 and 36 of cover 28 would make contact and protect all surfaces of board 10 from injury. Similarly, mounting board 10 in a conventional surfboard car roof rack (not shown) will not result in damage to board 10 because shock absorbing cover 28 will make contact with the surfboard rack rather than surfboard 10 itself.

It should be noted by those skilled in the art that widened midsections 38 and 40 correspond to the widest portion of surfboard 10. This configuration is preferred as it provides maximum protection and also assists in retaining protective cover 28 in position on surfboard 10. However, this configuration is not essential and other configurations are also contemplated as being with the scope of the present invention.

Also visible in FIG. 1 are upper position retaining straps 44 and 46 which interconnect resilient shock absorbing members 34 and 36 and assist in retaining shock absorbing cover 28 in position on surfboard 10. Both straps 44 and 46 are positioned remotely from either first pocket means 30 and second pocket means 32 as well as from each other. Preferably, straps 44 and 46 are formed of the same heoprene foam material as the remainder of cover 28, configured so as to provide minimal contact with the upper waxed surface 12 of surfboard 10. Corresponding lower position retaining straps 48 and 50 are shown in FIG. 5. As shown in the partial cross section of FIG. 2, upper and lower position retaining straps 44 and 48 (not shown) in conjunction with resilient shock absorbing members 34 and 36 (not shown) will completely encircle board 10 and thus prevent shock absorbing members 34 and 36 from inadvertently moving out of position relative to edges 20 and 22. Though at least one position retaining strap is preferred, it should be emphasized that position retaining straps are not essential to the practice of the present invention.

It is also contemplated as being within the scope of the present invention to provide at least one releasable coupling means (not shown) for releasably attaching at least one of the resilient shock absorbing members to either first pocket 30 or second pocket 32. For example, an ideal fastener for this application would be a hook and loop fastener as this form of releasable fastener is both strong and resilient and relatively impervious to damage from the elements. However, noncorrosive plastic snaps or buttons are also contemplated for this purpose. Similarly, releasable couplers may be utilized to attach one or more of position retaining straps 44 through 50 to shock absorbing members 34 or 36 to ease in the positioning of shock absorbing cover 28 onto surfboard 10. Moreover, it is also contemplated as being with the scope of the present invention to bisect either or both of resilient shock absorbing members 34 and 36 and to provide a releasable coupling means for connecting the bisected portions of each respective shock absorbing member. However, the unitary construction described herein is preferred.

The method of the present invention comprises inserting tip 24 of surfboard 10 into first pocket means 30, disposing resilient shock absorbing members 34 and 36 along edges 20 and 22 of surfboard 10, and then inserting rear base 26 into second pocket means 32. In this manner the resilient shock absorbing members 34 and 36 are stretched along edges 20 and 22 and assume the shaped contours of the respective longitudinal horizontal edge surfaces throughout their entire longitudinal and circumferential extent. Those skilled in the art will appreciate that the preferred shock absorbing cover 28 provided with position retaining straps 44 through 50 will require that tip 24 of board 10 first be threaded through the enclosing ring formed by position retaining straps 46 and 50 and the analogous ring formed by position retaining straps 44 and 48 prior to insertion into first pocket means 30.

Accordingly, the present invention discloses a method and apparatus for effectively protecting the forward tip, rear base, and longitudinal horizontal control edge surfaces of conventional surfboards and similar devices. What is more, the method and apparatus of the present invention achieve these desired results without significantly increasing the bulk or mass of the surfboard itself. Thus, use of the present invention does not complicate or alter storage or transportation of surfboards or the like as it does not produce a significant alteration to the size, shape or mass of the surfboard. Moreover, the apparatus of the present invention can be positioned on the surfboard simply and easily for temporary protection and is correspondingly easy to remove and store due to its low bulk, resilient flexible construction. Storage of the apparatus of the present invention is a simple matter as the flexible resilient construction of the preferred embodiment enables the apparatus to be folded or rolled into a compact bundle which can be stored conveniently in a minimum of space.

It should also be reemphasized that the preferred construction of the shock absorbing cover of the present invention is particularly well suited to beach environments where exposure to abrasive sand, salt water and intense sun rays would significantly shorten the life of conventional surfboard protective devices.

Those skilled in the art will also appreciate that the upper waxed surface of a surfboard will not be affected by utilization of the shock absorbing cover of the present invention. Nor will utilization of the cover affect the operation of conventional surfboard racks, surfboard bags or hard carrying cases. Thus, the apparatus of the present invention may be utilized in conjunction with these existing devices.

In the foregoing description of the present invention a preferred embodiment of the invention has been disclosed. It is to be understood that other mechanical and design variations are within the scope of the present invention. Thus, by way of example and not of limitation, the shock absorbing cover can be formed of materials other than the preferred neoprene foam sheet material. For example, terrycloth or elastic cloth laminates may be utilized. Similarly, a variety of position retaining straps may be utilized or positioned at various points along the longitudinal extent of the apparatus. Accordingly, the invention is not limited to the particular embodiment which has been illustrated and described in detail herein.

What is claimed:

1. A reusable, one-piece, low bulk, temporary, shock absorbing cover for completely protecting the forward tip, rear base, and the entire longitudinal extent of the horizontal control edge surfaces of a conventional surfboard or the like from scratches, abrasions, fractures or impact damage during transit or storage without contacting or affecting the waxed upper surface of the surfboard, said one-piece cover comprising:

a first resilient, shock absorbing pocket means for protectively encasing the forward tip of said surfboard;

a second resilient, shock absorbing pocket means for protectively encasing the rear base of said surfboard; and a pair of substantially identical, generally planar, resilient, shock absorbing members for protectively covering the entire longitudinal extent of the horizontal, control edge surfaces of said surfboard, each of said members provided with a broadened midsection and integrally attached to and longitudinally extending between said first and second pocket means, said shock absorbing members being spaced apart from one another in substantially parallel, opposed relationship.

2. A shock absorbing cover as claimed in claim 1, further comprising at least one position retaining strap disposed between and integrally interconnecting said shock absorbing members and being spaced remote from either of said first and second pocket means.

3. A shock absorbing cover as claimed in claim 1 wherein said first and second pocket means and said shock absorbing members are formed of neoprene foam sheet material.

4. A reusable, one-piece, low bulk, temporary, shock absorbing cover for completely protecting the forward tip, rear base and the entire longitudinal extent of the horizontal, control edge surfaces of a conventional surfboard or the like from scratches, abrasions, fractures or impact damage during transit or storage without contacting or affecting the waxed upper surface of the surfboard, said one-piece cover comprising:

a first resilient, shock absorbing pocket for protectively encasing the forward tip of said surfboard, said pocket formed of a neoprene foam sheet material and configured to completely encase said forward tip;

a second resilient, shock absorbing pocket for protectively encasing the rear base of said surfboard, said second pocket formed of neoprene foam sheet material and configured to completely enclose said rear base;

a pair of substantially identical, resilient, shock absorbing members for protectively covering the entire longitudinal extent of the horizontal control edge surfaces of said surfboard, each of said shock absorbing members formed of neoprene foam sheet material and configured to have a broadened mid section and a decreasing cross sectional area tapering toward each of its respective ends, each of said shock absorbing members being integrally attached to and longitudinally extending between said first and second pockets in substantially parallel spaced opposed relationship to one another; and a pair of position retaining straps disposed between and integrally interconnecting said shock absorbing members, each of said position retaining straps being spaced remote from one another and from said first and second pockets in generally coplanar parallel orientation to one another.

5. A method for effectively protecting the entire circumferential extent of the longitudinal, horizontal, control edge surfaces of conventional surfboards and the like from scratches, abrasions, fractures, and impact damage during transit or storage without significantly contacting or affecting the waxed upper surface of said surfboard or significantly increasing the bulk of said surfboard during storage or transit, said method comprising the steps of:

inserting the forward tip of said surfboard into the first pocket means of a reusable, resilient, one-piece, low bulk, temporary, shock absorbing cover for protecting the forward tip, rear base, and the entire longitudinal extent of the horizontal control edge surfaces of said surfboard, said shock absorbing cover having said first pocket means for protectively encasing said forward tip of said surfboard, a second pocket means for protectively encasing said rear base of said surfboard, and a pair of substantially identical, generally planar, resilient, shock absorbing members integrally attached to and longitudinally extending between said first and second pockets and being spaced apart from one another in substantially parallel, opposed relationship;

disposing said shock absorbing members along said entire longitudinal extent of said horizontal, control surfaces by stretching and forming said shock absorbing members to assume the shaped contours of said longitudinal, horizontal, control edges along their respective entire longitudinal lengths; and inserting said rear base of said surfboard into said second pocket means.

* * * * *